US005906420A

United States Patent [19]

Rozier, Jr. et al.

[11] Patent Number: 5,906,420

[45] Date of Patent: May 25, 1999

[54] OFFICE SYSTEM COMPRISING LINKABLE DESK AND STORAGE UNITS

[75] Inventors: Charles P. Rozier, Jr., County of New York; Robert E. Reuter, County of Suffolk, both of N.Y.; Robert A. Melhuish; Michael L. McAllister, both of County of Montgomery, Pa.; James A. Petronio, County of New York, N.Y.

[73] Assignee: Knoll, Inc., East Greenville, Pa.

[21] Appl. No.: 08/869,011

[22] Filed: Jun. 4, 1997

[51] Int. Cl.[6] ..... A47B 81/00

[52] U.S. Cl. ..... 312/223.6; 52/36.1; 312/223.3; 312/203; 312/198

[58] Field of Search ..... 312/223.3, 223.6, 312/194, 198, 203; 108/50.01, 50.02; 52/36.1, 239

[56] References Cited

U.S. PATENT DOCUMENTS

| | | | |
|---|---|---|---|
| 4,094,561 | 6/1978 | Wolff et al. | 312/223.6 |
| 4,272,136 | 6/1981 | Sengua | 312/223.3 X |
| 4,323,291 | 4/1982 | Ball | 312/223.6 X |
| 4,382,642 | 5/1983 | Burdick . | |
| 4,654,756 | 3/1987 | Wilson et al. | 312/223.3 X |
| 4,928,465 | 5/1990 | Von Haucke | 52/239 |
| 4,948,205 | 8/1990 | Kelley . | |
| 4,974,915 | 12/1990 | Bussard | 52/239 X |
| 5,121,698 | 6/1992 | Kelley . | |
| 5,183,319 | 2/1993 | Pearson et al. | 312/198 X |
| 5,272,988 | 12/1993 | Kelley et al. . | |
| 5,428,928 | 7/1995 | Hellwig et al. | 52/36.1 X |
| 5,451,101 | 9/1995 | Ellison et al. | 312/223.6 |
| 5,473,994 | 12/1995 | Foley et al. | 312/194 X |
| 5,544,593 | 8/1996 | Canfield et al. . | |
| 5,606,919 | 3/1997 | Fox et al. | 312/223.6 X |
| 5,606,920 | 3/1997 | Meyer et al. . | |
| 5,609,112 | 3/1997 | Meyer et al. . | |

OTHER PUBLICATIONS

Herman Miller "The Office: New Levels of Performance in a New Working World" brochure, Herman Miller, Inc. 1996 (15 pages).

"An Urge to Merge" by Roger Yee, *Contact Design*, p. 20, Jul. 1996.

Steelcase "Context Freestanding Furniture System" Product Guide, Steelcase, Inc. 1989 (see pp. 11, 14, 18, 44–47).

Haworth "Furniture that Works—Office Desking System" brochure, Haworth, Inc. 1995 (12 pages).

Haworth "Fixed and Incremental Height Tango Desks" Installation Instructions, Haworth, Inc. (4 pages).

Haworth "Hand Crank Adjustable Height Tango Desks" Installation Instructions, Haworth, Inc. (4 pages).

Haworth "Tango Desk Grid Countertop and Desk Mount Screen" Installation Instructions, Haworth, Inc. (2 pages).

*Primary Examiner*—Jose V. Chen
*Assistant Examiner*—Stephen Vu
*Attorney, Agent, or Firm*—Buchanan Ingersoll, P.C.

[57] ABSTRACT

An office furniture system of free standing furniture elements which can be linked to each other comprises a modular desk unit and a modular storage unit. The modular storage unit occupies the same floor footprint as a rectangular desk unit. The separate storage unit enhances the storage capacity of an office layout since the mounting of drawers and shelves are not limited by the desk unit configuration. The storage unit has compatible lay-in wiring trays, accepts compatible modular power components and accepts the same privacy partition panels and other accessories as are mounted to the desk units. When the desk unit and the storage unit are linked into an integrated office design, a continuous pathway is provided for the electrical, communication and data wiring required for the office system. Power cables are physically separated from the data and communication wires. Since the vertical space above the wiring trays remains accessible, cabling can be easily routed at any time through the system, enhancing office system expansion and design.

24 Claims, 4 Drawing Sheets

OFFICE SYSTEM COMPRISING LINKABLE DESK AND STORAGE UNITS

BACKGROUND OF THE INVENTION

1. Field of the Invention

The present invention is directed to an integrated workstation for office systems, and more particularly to a linkable desk and storage unit having compatible wire management systems, especially usable for desks having adjustable work surfaces.

2. Background of the Invention

Modern office floor plans increasingly call for an open office furniture system wherein free standing furniture elements are linked together to form work space areas for the individual workers. Typically, modular desk units are combined to form a work space area in which individual components are attached to the desk units to form a personalized work space. These desk units often comprise an L-shape. Modular office panel systems are well known in the art such as evidenced by U.S. Pat. No. 4,567,698 to Morrison, which patent is assigned to the present assignee and is hereby incorporated by reference herein. As is common practice, interchangable wall panels can be connected together in a myriad of configurations so as to provide the desired work space. Within the work space, desktop work areas and storage units, such as drawers or shelves, can be attached to the wall panels so as to personalize the work space for the individual. With these prior art systems, in order to provide sufficient storage capacity, these drawers and shelves can be attached to the wall panels either above or below the desktop work surface.

In order to provide adequate storage capacity within the work area, drawer units are typically associated with the desktop in several ways. One common method is to secure, such as by bolting, a drawer unit to the underside of the desktop. Another common method is to provide a pedestal unit comprising a bank of drawers which can be a separate unit from the desk unit which is positioned underneath the desktop. Although providing desired storage capacity, these arrangements can create other problems.

More modern workstations provide a desktop which has a height adjustable surface. This is to accommodate the preferences of various individuals so as to place the desktop at a comfortable working height. It is desirable to do this so that a computer keyboard, for example, is placed at the proper height with respect to the individual working at the desktop so as to reduce the chance for discomfort to the worker which may result in common workplace injuries. However, with the storage capacity necessary for these work systems, the common practice of undermounted drawer systems gives rise to certain difficulties. For example, if the drawer unit is mounted to the undersurface of the desk, this adds weight to the adjustable desktop. This added weight can limit the adjustability of the work surface in that the height adjustment mechanism must accommodate the weight of the materials that may be placed within the drawers in addition to the drawer unit itself. Although this problem can be eliminated by providing the separate pedestal drawer assembly positioned underneath the work surface, this arrangement itself presents undesirable consequences for the individual. For example, the pedestal units which are placed underneath the work surface are often be placed within the confines of the supports or legs for the work surface. Thus, this decreases the lateral space underneath the desk which is available for the person to sit comfortably at their desk or to place their legs underneath.

Additionally, since the pedestal is of a fixed height, the lower limit of the desktop is restricted by the height of the pedestal, while a gap may be created between the pedestal unit and desktop when the latter is placed in the raised position. In addition, a separate modular storage unit is not available such that the individual using the workstation, in order to personalize the workstation for their particular needs, must purchase separate components in order to provide the needed storage capacity. Assembled in this manner, these components do not afford the optimum configuration for the individual due to the limitations outlined above.

When office desk systems have work surfaces which are adjustable in height, the wireway channel is preferably placed below the lowest portion of the work surface travel, to keep it out of sight and away from the desktop activities. The routing of cabling, such as for electrical power, communication or data, must be provided for in the complete integrated workstation. To transmit the wiring from unit to unit, the respective wireways are typically connected end to end, or in the case of L-shaped corner desks across both desks using two wireways connected at the corner. The typical workstation must accommodate a myriad of electrical and communication equipment, such as a telephone, dictating machine, and a computer with its associated monitor, keyboard and central processing unit (CPU). It is desirable to not only hide these wires within the workstation for visual effect, but to also provide an out-of-the-way location for them so as to not interfere with the available work area. Moreover, it is desirable to separate the electrical power lines from the data and communication lines. Some local building codes specifically require that the power cables be separated from the data communication cables for various reasons, one of which being electromagnetic interference that may arise when these different cables are placed in close proximity to each other.

To establish visual privacy, partition panels or screens are mounted onto the back of the desks. For the file and drawer storage, separate cabinets (such as pedestal units) are nested beneath the desks, forward of the wireways. In addition to requiring extra parts such as for mounting the units, this storage solution restricts storage capacity. If the storage cabinets are suspended from the desktops, their weight must be borne by the desk which severely limits storage capacity by weight. Conversely, if the storage cabinets rest on the floor independently of the desk, the desk legs still obstruct spaces near either end of the work surface, thereby reducing the width available for storage cabinets.

Difficulties may arise after the office system components have been assembled to provide the integrated workstation. It is not uncommon for either new workers to be hired such that more work space must be added, or an individual work space needs to be modified in order to accommodate more equipment or the individual wishes of a new worker. Even though the work space had previously been assembled into a finished unit, access to the cable routing systems must be available to permit these changes without having to disassemble the completed workstation. It is known to provide an open area for the routing of cables within an office system, such as shown in U.S. Pat. No. 5,473,994 issued to Foley et al. It is disclosed therein to provide separate channels or trays underneath the desktop surface for the routing of the various cables. However, the system of Foley et al. presents several disadvantages. Most apparent is that conventional storage units, such as the undermounted drawer units or pedestal units, cannot be placed completely under the work surface due to the fact that the trays extends laterally from the back panel towards the front of the work surface. These trays thus require valuable space underneath the desk unit so as to practically eliminate storage area that an individual may need. Moreover, the lower tray extends into the area where a person may place his or her legs which can limit the mobility of the individual within the work space.

What is needed then is an office system which provides an integrated work space having sufficient storage capacity which can accommodate a desk unit having an adjustable work surface. It would be most desirable to have a separate storage unit which can be linked with a desk unit within an open office system, which provides for ease of running of cabling both before and after the units have been assembled within the office system. Also, such an office system must accommodate privacy screens, for example, so as to provide an individual with a unique and private work space.

SUMMARY OF THE INVENTION

It is therefore an object of the present invention to provide an integrated workstation for an open office system which comprises a separate storage unit which can be positioned with a desk unit in a manner most suitable to an individual worker.

It is another object of the present invention to provide a storage cabinet which does not adversely limit the adjustability of a height adjustable desktop.

It is a further object of the present invention to provide a storage unit which permits the installation and routing of cabling to and through the unit before and after its assembly and integration in combination with a desk unit into a completed workstation.

The above objects and advantages are attained by the present invention, according to which, briefly stated, an office furniture system of free-standing furniture elements is provided. The individual furniture elements can be linked together and preferably comprise a modular desk unit and an individual modular storage unit which occupies substantially the same floor footprint as a corresponding rectangular modular desk unit. The modular storage cabinet includes similar lay-in wiring channels or trays to those of the desk unit and accepts the same privacy panels and other accessories which can be mounted to the desk unit. The modular storage unit may optionally have provisions for mounting vertical stanchions at each end of the storage unit work surface, upon which an overhead storage cabinet or work light, for example, may be mounted.

According to a first embodiment of the present invention, a cabinet for use in an integrated furniture system defines a storage area and includes at least a back surface and a top surface. The cabinet comprises means for attaching a cable management member thereto, the cable management member being attached to the back surface. A first tray is attached to the back surface so as to define an area under the first tray, and a second tray is attached to the back surface within the area. An access port is provided in the back surface whereby a cable in the second tray may be accessed from the storage area by means of the access port.

In a second embodiment of the invention, an integrated workstation for an office furniture system is provided, the integrated workstation comprising a modular desk unit and a separate modular cabinet unit. The desk unit further comprises a work surface and a first cable management system secured to the desk unit at a vertical location which is below the work surface. The first cable management system is generally accessible when the desk unit is assembled into the integrated workstation. The cabinet storage unit defines a storage area and comprises a second work surface, and a second cable management system. The second cable management is secured to the cabinet at substantially the same vertical location as the first cable management system whereby a generally continuous cable pathway is created with the first cable management system and the second cable management system when the desk unit is operatively connected to the cabinet storage unit to form at least a section of the integrated workstation. Preferably, the work surface of the desk unit is vertically adjustable and includes lower and upper height limits, and the continuous cable pathway is positioned below the lower height limit.

BRIEF DESCRIPTION OF THE DRAWINGS

Various other objects, features, and advantages of the invention will become more apparent by reading the following detailed description in conjunction with the drawings, which are shown by way of example only, wherein.

DETAILED DESCRIPTION OF THE PREFERRED EMBODIMENTS

Figure 1:
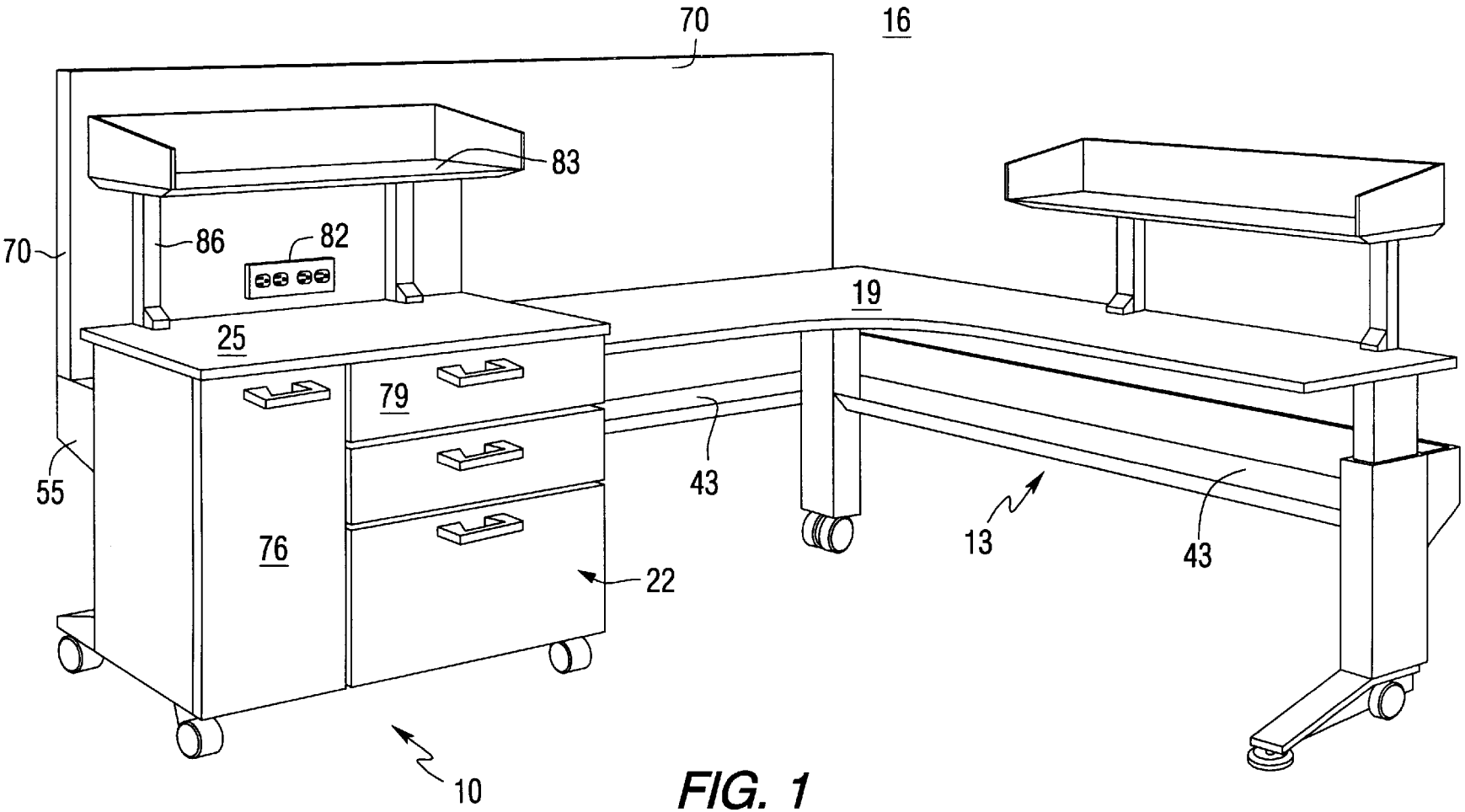
FIG. 1 is a perspective view of an integrated workstation having separate desk and storage units according to the present invention.

Referring now to the drawings in detail, FIG. 1 shows a perspective view of the linkable storage cabinet unit 10 of the present invention assembled in combination with a desk unit 13 to form a modular work area 16. Although the modular office system is shown as generally comprising the desk unit and the storage unit it is readily apparent to those skilled in the art that additional modular units or panels may be associated therewith in various combinations. The desk unit 13 additionally has an adjustable height work surface 19, which can be positioned along a vertical height range having upper and lower height limits, according to the wishes of the user.

The key feature of the present invention can be found in the separate integrated storage unit 10 which provides ample storage capacity for the user in addition to serving other functions, without the limitations previously found with prior art workstation components. By integrating most of the storage functions into a separate storage unit, the downward adjustment of the work surface desktop 19 is not limited as it is with conventional drawer units under the desk and the knee room below the desktop is not restricted. The storage unit generally comprises a storage cabinet 22, which can consist of different combinations of drawers and open storage areas with or without doors, and a second desktop or work surface 25. This work surface typically is fixed with respect to the storage cabinet and is not vertically adjustable as is the desk unit work surface.

Figure 2A:
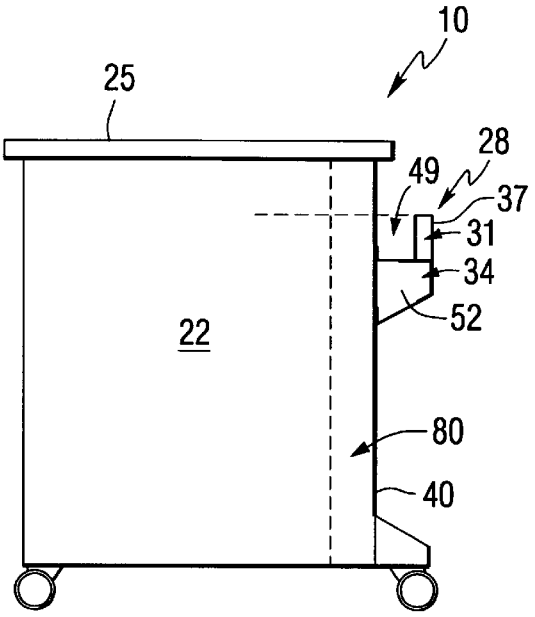
FIG. 2, consisting of FIGS. 2A and 2B, shows side elevational views of alternate embodiments of a linkable storage cabinet of the present invention.
Figure 2B:
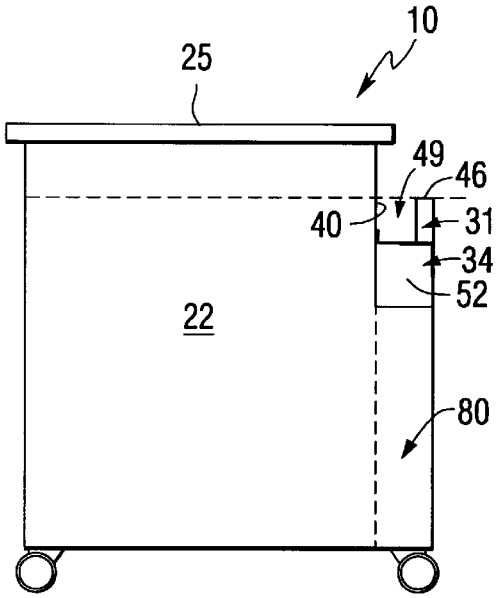
Figure 3:
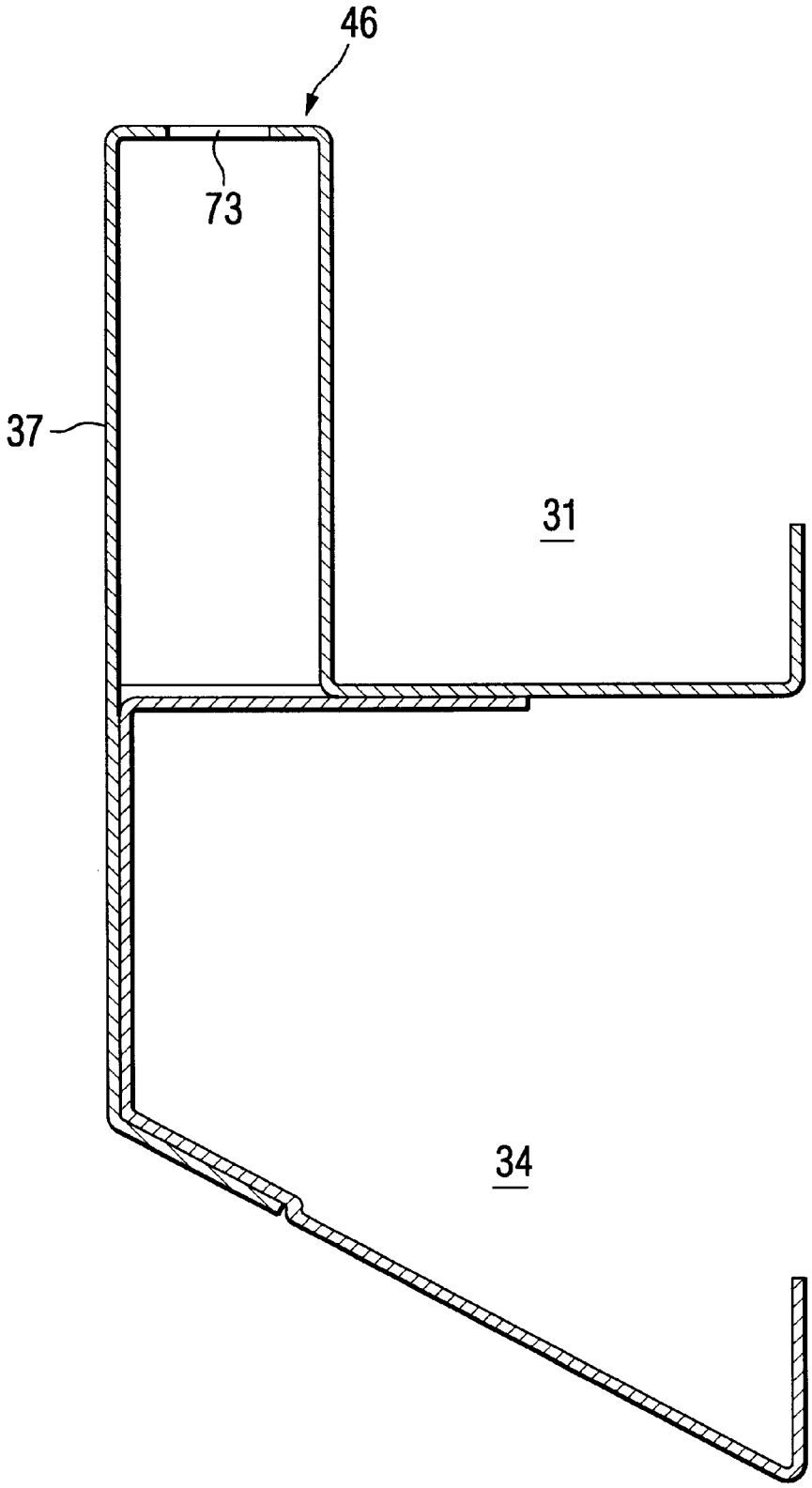
FIG. 3 is a detailed view of a mounting arrangement for the wireway tray and cable access areas for the storage cabinet as shown in FIG. 2.

An essential feature of the integrated storage unit is a cable management assembly 28 which provides wire or cabling management compatible with that provided on the desk unit having an adjustable height work surface 19. To avoid electrical interference, it is desirable that data cables not be allowed to come in close proximity to power cables. As shown in FIGS. 2 and 3, the integrated storage unit 10 provides for generally open access to two trays 31, 34 or channels for physically separate electrical power and data cabling pathways. Although the two trays can be positioned adjacent to each other at the same height, in the preferred embodiment shown the trays are placed at different heights so that the cables in one tray do not intersect those in the other tray even when routed around corners or through intersections between adjacent linked furniture units. Although the storage cabinet may be extended rearwards so as to include the volume under the cable management assembly (FIG. 2B), in the preferred embodiment shown (FIG. 2A) the storage cabinet remains forward of the cable management assembly which is mounted externally on the rear surface of the cabinet. In this way the cable management assembly can be easily installed onto or omitted from the unit as desired. As shown in detail in FIG. 3, attached to the back of the storage unit is the cable management assembly which comprises the first cable tray 31, a second cable tray 34, and a mounting bracket or support member assembly 37. The bracket is attached to the back surface 40 of the storage cabinet in such an manner that the first cable tray is positioned along the rear of and below the level of the work surface 25 while the second tray is below the first tray. The bracket is preferably attached to the back surface by screws (not shown) inserted through screw holes and threaded into the back surface. Most preferably, the first 31 and second 34 wire trays are at the same height as compatible wire trays of the cable management system 43 in the desk unit 13. These are positioned below the surface of the fixed desktop 25 of the storage unit 10 such that the cables remain both out of view of the individual and also do not interfere with the work surface area. The bracket 37 includes an attachment area 46 for privacy screens, as will be described in detail hereinafter. The bracket may either be elongated so as to extend along the rear of the cable trays or it may be shorter in length so that a bracket is mounted at each end of the trays and the trays extend between them. When the mounting bracket 37 is attached to the storage cabinet, a gap 49 is created between the mounting bracket 37 and the back surface 40, such that the first tray 31 occupies a portion of the gap and defines a generally enclosed area 52 below the first tray.

In a most preferred embodiment, the cable management assembly is located along the back of the storage unit such that the two wire trays are at vertical heights which are below the lowest positionable height of the vertically adjustable work surface of the desk unit. In this manner, the storage unit can be aligned or linked with the adjustable height desk unit while allowing cabling to pass through the desk and storage unit in an unobstructed manner, without limiting the vertical range of the desk unit's adjustability.

An end panel 55 may be provided over each lateral end of the cable management assembly 28. The top of the generally U-shaped first cable tray may be adapted to receive an optional removable cover plate (not shown) to prevent either items from falling into the wire tray or the cables from projecting above the cable tray.

Figure 4:
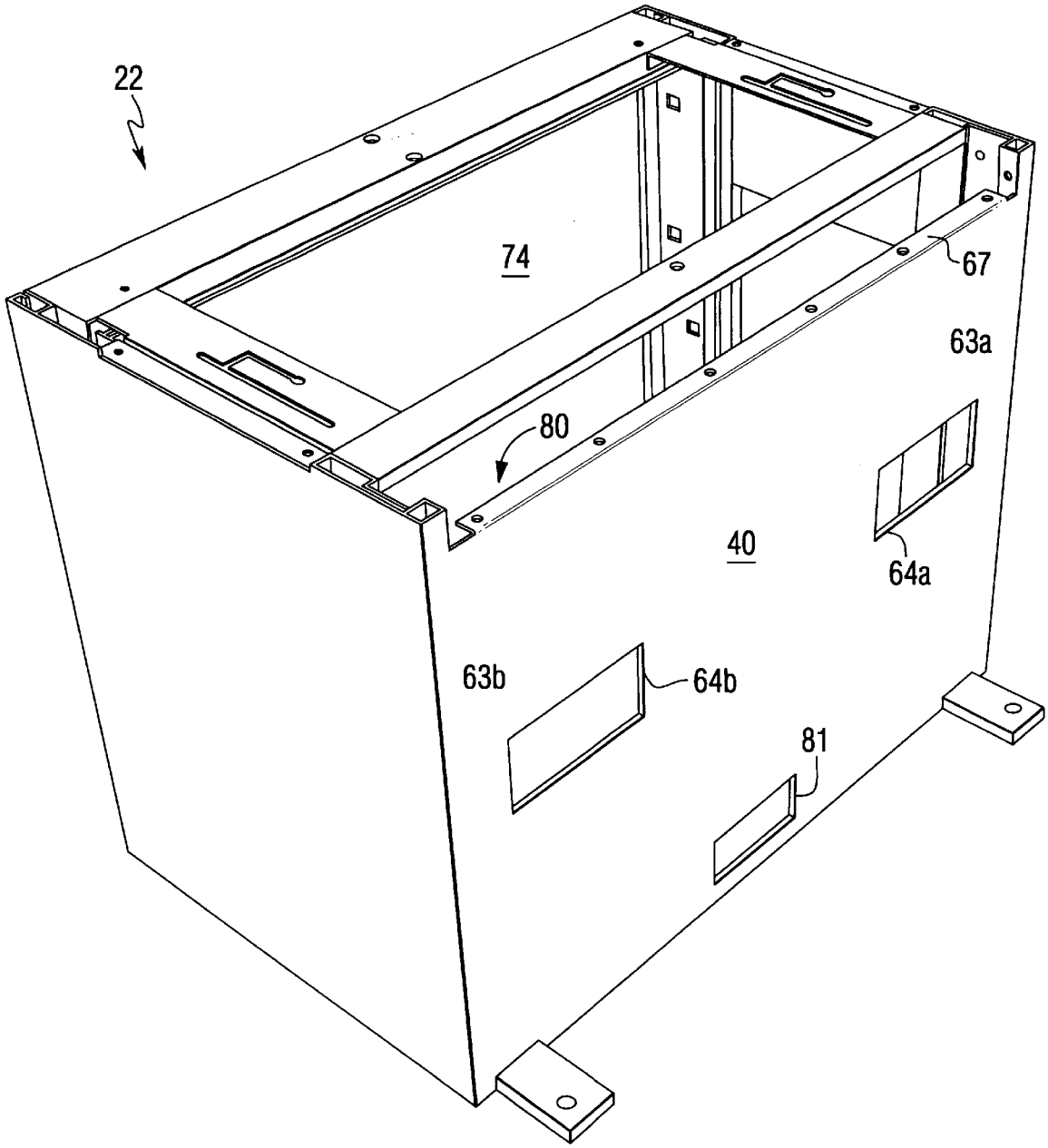
FIG. 4 is a back elevational view of the cabinet of the present invention.

As can be seen in FIG. 2, the cable management unit 28 is attached to the back of the storage unit such that the first or upper tray 31 is below the height of the storage unit's work surface 25; and the second or lower tray 34 lies below the first tray. Incorporated into the storage unit back panel 40, preferably at both lateral ends 63*a*, 63*b*, are a pair of access ports 64, as shown in FIG. 4. A pair of access ports is provided to give access to the lower tray 34, especially for the installation and routing of cables after the workstation has been assembled, when other units may block access to the rear and sides of the storage unit. These ports may be located on either the bottom of the lower tray if the storage cabinet includes the volume underneath the cable management assembly, or more preferably may be located as shown on the rear surface of the storage cabinet which also serves as the front most vertical face of the cable tray 34. A slot 67 is provided at the top of the cabinet, so as to provide a means for routing cabling to the desk top from the lower tray. This feature will be described more fully hereinafter.

For the purposes of the following description, it will be assumed that electrical power cables are routed through the lower tray whereas the communication and data cables are laid into the upper tray. Data cables generally are in the form of a bundle of long, continuous cables extending from a common infeed point and passing through a series of linked modular furniture units which comprise a cluster of workstations. It is inconvenient to pass or fish them through holes in the modular furniture units, and such fishing furthermore makes it impossible to remove a single furniture unit without first unstringing the data cables from all the subsequent furniture units in the cluster. It is therefore desirable that the furniture data cable trays be open all along their length so that the data cables can be continuously laid in or lifted out without fishing through holes.

Since power cables are generally short, unpluggable elements, continuous lay-in access is not necessary, unlike data cables. Thus, it is possible to pass power cable sections through ports, or to fish such cables through holes, and then plug the cable sections together without compromising versatility. It will be readily appreciated, however, that power cables can alternatively be routed through the upper tray and communication cables routed through the lower tray according to the wishes of the user.

The power cables pass from one side 63*a* of the storage unit 10 to the opposite side 63*b*, extending therefrom to either be linked to a source of electrical power or to be routed through a corresponding office system or workstation within the open office floor plan. Since the desk has a compatible wire management system 43 disposed below the lower limit of the adjustable desktop 19, cables can be easily routed through the desk and storage unit in a continuous manner within an assembled integrated workstation or cluster of workstations. And because the area above the storage unit work surface remains accessible and the upper wire tray 31 extends beyond the back of the cabinet, data and communication cables can easily be laid in place within the tray continuously from above without fishing through holes. Thus, the data and communication cables can easily be slipped over the back of the storage unit 10 such that they rest within the upper tray. When the communication cables have been placed within the tray, the optional cover plates can be secured to the tray. When the storage unit and desk are integrally linked together, the communication and power pathways are readily provided by the generally continuous cable pathway created by the respective cable management systems 43, 28 of the desk and cabinet.

Optionally, a privacy screen 70 can be attached to the top surface of the bracket, such as by posts inserted into openings 73 in the bracket. The vertical space above the first tray 31 is not obstructed by the privacy screens, so it remains readily accessible after integration into an office system. The storage unit accepts privacy screens similar to those used with the desk units, so that a uniform, visual enclosure around any combination of desks and storage units is possible.

When a number of desks and storage units have been assembled together into a cluster of adjacent workstations, access to the back and sides of some of the storage units may be obstructed. One of the key features of the storage unit is that access to both the first and second trays is retained when the sides and rear of the storage unit are not accessible. In order to route cables through the upper tray, the person need only remove the cover plate from the upper tray. Cables can then be laid into the tray 31. When the desired cables have been installed, the optional cover plate may be again positioned over the tray. In order to gain access to the lower tray 34, the storage unit is provided with vertical access to the lower tray by minimal slight removal of the storage unit work surface 25.

In order to gain access to the storage area 74 within the cabinet 22 under the surface of the desktop from the front of the storage unit, either the door 76 or the upper drawer 79 is opened, depending on the configuration of the storage area, to reveal the undersurface of the desktop. Preferably, two screws (not shown) are provided at the front of the unit which hold the work surface 25 in place. In order to gain access to the lower tray 34, these screws are removed The user need only then slide the desktop forward in tracks along the top of the cabinet to gain access to the lower tray.

The rear most portion 80 of the storage volume is never intruded upon by the drawers or shelves, and is reserved for cable storage and access. Sliding the work surface forward gives access from above to this reserved volume. It is alternatively possible to hinge the rear portion of the work surface upward, or to remove all or only the rear portion of the work surface, in order to gain access from above to the reserved volume 80. The reserved volume has port 64*a*, port 64*b*, a top port or slot 67 defined by the bottom of the work surface and a relief in the upper rear of the back surface of the cabinet, and a port 81 on the bottom rear or floor of the cabinet. The lower tray and cables can be accessed through the access ports 64*a* and 64*b*. Since the desktop 19 has been moved forward or retracted from the back of the cabinet, the cable may be passed between ports 64*a* and 64*b* either in the second tray or inside the cabinet in the reserved volume 80. The cable is then routed, such as by pushing or pulling the cable, to the opposite side of the cabinet 22 and exits out of the second tray on the opposite side 63*b*. Optionally, a power or cable outlet box 82 may be provided along the length of the work surface such that the power cable (or the communication cable) can be attached to the outlet so as to provide a source of electrical power, for example, to the top of the cabinet desk. The wire is inserted into the back of the storage area from access port 64*a* to the outlet, and is then routed from the outlet to the access port on the other side 63*b* into the lower tray to be routed to either another workstation or to the source of electrical power as set forth above. In addition, cable may exit the slot 67 at the top or bottom port 81 of the cabinet. For smaller width cabinets, a single access port may be provided towards the center of the back of the cabinet so as to access cables into and through the second tray 34.

Another optional feature of the present invention is the mounting of overhead accessories 83, such as an overhead storage shelf or cabinet, above the work surface of the cabinet. Vertical support members or stanchions 86 may be attached at each end of the cabinet such that supports extend upward to mount a shelf or a storage bin above the storage cabinet. Additionally, a workstation light may be mounted under the shelf or bin. In either event, the vertical stanchions 86 are mounted to the cabinet 10 in such a manner that the upper tray 31 remains accessible and the desktop 25 is still movable relative to the storage unit to provide the access to the lower tray 34 as described herein.

Figure 5:
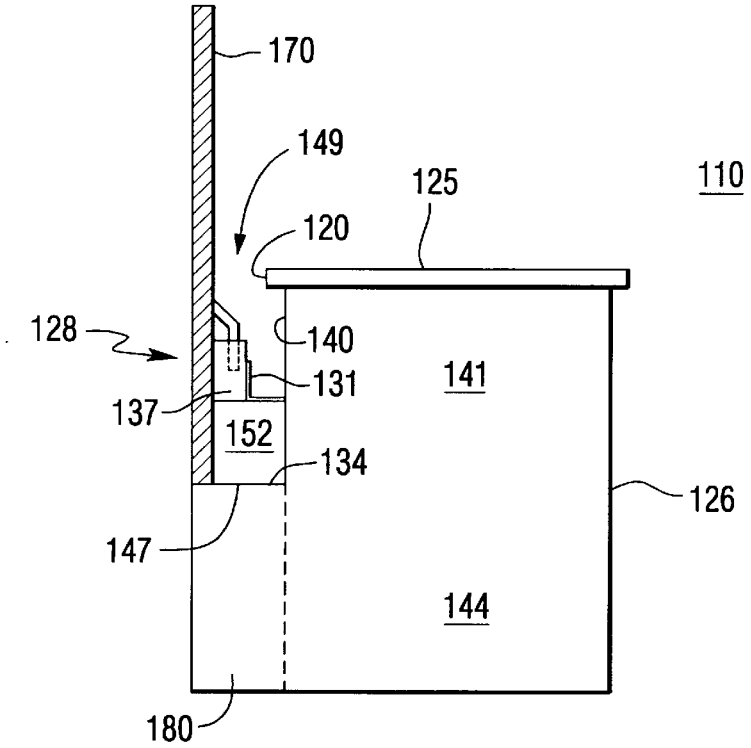
FIG. 5 is a side elevational view of an alternate embodiment of the present invention.

Referring now in detail to FIG. 5, an alternate embodiment of the present invention is disclosed. As shown therein the storage cabinet 110 comprises a desktop or work surface 125, a left side panel 126 and a back surface 140. Although only the left side panel 126 is shown, it is to be understood that an identically-shaped right side panel is also included. The work surface 125, back surface 140 and side panels 126 define a storage volume within the cabinet. The side panels 126 are further comprised of a top portion 141 and a bottom portion 144, the bottom portion having a length longer than that of the top portion so as to define a ledge 147. In this manner, the area behind the cabinet 110 defined by the ledge 147 would also define a rear portion 180 of the storage cabinet 110 which is reserved for a cable management system 128 as will be described in detail hereinafter.

A bracket 137 is attached to the back surface 140, and preferably in an area above the ledge 147 and below the work surface 125. The bracket has attached thereto a generally U-shaped first cable tray 131. As before, the bracket 137 includes means for attaching a privacy screen 170, such that a gap 149 is defined between the privacy screen and a back portion 120 of the work surface 125, so that the vertical space above the first tray 131 remains accessible at all times. In the preferred embodiment, the first cable tray extends across the entire horizontal length of the back surface, to define a first cable pathway from the left side panel to the right side panel. Additionally, the enclosed area 152 defined by the first tray 131, bracket 137, ledge 147, privacy screen 170 and back surface 140 comprises a second cable tray or pathway 134. Thus, a second cable pathway extends horizontally across the back of the cabinet. As before, the work surface may be partially removable from the cabinet so that the second cable tray 134 is vertically accessible by means of the rear portion 180 of the storage volume. Therefore, a cable management system 128 providing physically separate cable pathways for electrical and data or communication cables is defined on the back surface of the storage cabinet 110.

In a further embodiment, means for accessing the second tray can be provided by access ports which are included in either the back surface 140 as discussed above, or in the bottom of the first tray. In this way, electrical cables, for example, can be inserted into and through the second cable pathway by fishing the cable into the opening of the left side, accessing the cable via the access portion to pull it through the second pathway, and exiting the cable from the compatible opening on the right side. Optionally, the first tray may be removable, either rather than or in addition to the work surface being partially removable, so as to access enclosed area 152 defining the second cable pathway 134.

In this manner, the present invention provides an independent and compatible modular furniture unit which incorporates ample storage, power and data cable functionality compatible with that provided in a conventional work desk in that separate pathways are provided for data and power cables, and provision for attaching privacy screens. In a workstation 16, ample storage is contained within the storage unit 10 thereby avoiding the compromises associated with locating storage below the desk 13 itself. Such compromises would include reducing the width of the user's knee space and, when the desk has a vertically adjustable work surface, limiting the downward adjustability. The power and data cable functionality most desirably includes the ability to install the power and the data cables independently of each other in any sequence, and to do so even when the storage unit is obstructed on both sides and on the back. In the preferred embodiment of the present invention, the upper tray is always accessible directly from above, and the lower tray can be accessed independently of the upper tray by partially removing the cabinet's work surface. This provides access from above to the rearward portion of the cabinet's storage volume, which is reserved for cable access and which is provided with ports into the lower tray. Thus, the present invention provides independent and compatible modular furniture units that are interchangeable to provide a section of a modular office having ample storage capacity without limiting either the adjustability of the desk unit or the sequence of installation of the cables or of the furniture units. The modular furniture system provides linkable storage units which can occupy substantially the same modular spaces as corresponding rectangular desks and which have similar wiring capabilities. Additionally, because of their wiring capabilities, the storage units are not restricted to usage as end units wherein the passage of electrical and data communication cables to another work station is not necessary. This allows the layout of offices including both desks and storage units with great flexibility. The present invention offers all the functionality required for a distinct and compatible modular integrated storage unit having ample storage space in a workstation for an open office system.

While specific embodiments of the invention have been described in detail, it will be appreciated by those skilled in the art that various modifications and alterations would be developed in light of the overall teaching of the disclosure. Accordingly, the particular arrangement disclosed are meant to be illustrative only and not limiting as to the scope of the invention which is to be given the full breadth of the appended claims and in any and all equivalents thereof.

We claim:

1. An integrated workstation for an office furniture system, the integrated workstation comprising:

A) a desk unit further comprising i) a work surface, and ii) a first horizontal cable management system secured to the desk unit at a vertical location which is below the work surface, said first cable management system being generally accessible when the desk unit is assembled into the integrated workstation; and B) a cabinet storage unit defining a storage area and further comprising iii) a second work surface, and iv) a second horizontal cable management system, the second cable management system being secured to a back surface of the cabinet at substantially the same vertical location as the first cable management system whereby a generally continuous cable pathway is created with the first cable management system and the second cable management system when the desk unit is operatively connected to the cabinet storage unit to form at least a section of the integrated workstation, wherein the second cable management system further comprises:

a) a first cable tray attached to the back surface so as to define an area under the first tray;

b) a second cable tray attached to the back surface and the first cable tray in the area under the first tray so as to define a generally enclosed area; and c) means for accessing a cable installed in the second cable tray comprising a first access port adjacent one end of the back surface and a second access port adjacent a second end of the back surface, whereby a second cable pathway is defined by the first access port, the second cable tray and the second access port.

2. The integrated workstation as defined in claim 1, wherein the work surface of the desk is vertically adjustable, and includes a lower height limit and an upper height limit.

3. The integrated workstation as defined in claim 2, wherein the continuous cable pathway is below the lower height limit.

4. The integrated workstation as recited in claim 2, wherein the second work surface is at a fixed vertical height.

5. The integrated workstation as recited in claim 1, wherein the first cable management system comprises a first wire tray and a second wire tray.

6. The integrated workstation as recited in claim 5, wherein the first cable tray is adapted to receive data or communication cables, and the second cable tray is adapted to receive electrical power cables.

7. The integrated workstation as recited in claim 6, further comprising a power outlet box attached to the second work surface and operatively connected to the second cable tray.

8. The integrated workstation as recited in claim 1, wherein the first cable tray comprises a generally U-shaped member.

9. The integrated workstation as recited in claim 1, wherein the first cable tray is positioned at a vertical height below the second work surface.

10. The integrated work station as recited in claim 1, wherein the first cable tray is removable from the back surface such that the second tray is vertically accessible.

11. The cabinet as recited in claim 1, wherein the second tray is positioned below the first tray, and said means for accessing a cable in the second tray is provided at the bottom of the first tray.

12. The integrated workstation as recited in claim 1, wherein the second work surface is partially removable from the cabinet storage unit such that the storage area remains accessible.

13. The integrated workstation as recited in claim 1, further comprising means for mounting a vertical support member to cabinet storage unit, the vertical support member adapted to receive accessories mounted thereon above the second work surface.

14. The integrated workstation as recited in claim 1, wherein said first and second horizontal cable management system each comprises means for attaching a privacy screen thereto whereby said first and second horizontal cable management systems each remains vertically accessible.

15. The integrated workstation as recited in claim 1, further comprising a cable outlet box attached to the second work surface, the cable outlet box being connectable to the second cable management system.

16. The integrated workstation as recited in claim 1, wherein the first cable tray comprises means for attaching a privacy screen thereto whereby the first cable tray remains vertically accessible.

17. An integrated workstation for an office furniture system, the integrated workstation comprising:

A) a desk unit further comprising i) a work surface, and ii) a first horizontal cable management system secured to the desk unit at a vertical location which is below the work surface, said first cable management system being generally accessible when the desk unit is assembled into the integrated workstation; and B) a cabinet storage unit defining a storage area and further comprising iii) a second work surface, and iv) a second horizontal cable management system, the second cable management system being secured to a back surface of the cabinet at substantially the same vertical location as the first cable management system whereby a generally continuous cable pathway is created with the first cable management system and the second cable management system when the desk unit is operatively connected to the cabinet storage unit to form at least a section of the integrated workstation, wherein the second cable management system further comprises:

a) a first cable tray attached to the back surface so as to define an area under the first tray, the first cable tray including means for attaching a privacy screen thereto whereby the first cable tray remains vertically accessible;

b) a second cable tray attached to the back surface and the first cable tray in the area under the first tray so as to define a generally enclosed area; and c) means for accessing a cable installed in the second cable tray.

18. The integrated workstation as recited in claim 17, wherein the first cable tray is positioned at a vertical height below the second work surface.

19. The integrated workstation as recited in claim 17, wherein the first cable tray is removable from the back surface such that the second tray is vertically accessible.

20. The integrated workstation as recited in claim 17, wherein the second tray is positioned below the first tray, and an access port is provided at the bottom of the first tray.

21. The integrated workstation as recited in claim 20, wherein the access port comprises a first access port adjacent one end of the back surface and a second access port adjacent a second end of the back surface, whereby a second cable pathway is defined by the first access port, the second cable tray and the second access port.

22. The integrated workstation as recited in claim 17, wherein the access port is provided in the back surface such that the second cable tray may be accessed from the storage area by means of the access port.

23. The integrated workstation as recited in claim 17, wherein the second work surface is at a fixed vertical height.

24. The integrated workstation as recited in claim 17, wherein the second work surface is partially removable from the cabinet storage unit such that the storage area remains accessible.

* * * * *